US005475936A

United States Patent [19]

Cavasin

[11] Patent Number: 5,475,936

[45] Date of Patent: Dec. 19, 1995

[54] SKATE WITH ALIGNED WHEELS

[75] Inventor: Giuseppe Cavasin, Montebelluna, Italy

[73] Assignee: Roces S.r.l., Montebelluna, Italy

[21] Appl. No.: 98,188

[22] Filed: Jul. 28, 1993

[30] Foreign Application Priority Data

Jul. 31, 1992 [IT] Italy ..... TV92A0089

[51] Int. Cl.[6] ..... A43B 5/04; A63C 17/06

[52] U.S. Cl. ..... 36/115; 280/11.22; 280/11.2

[58] Field of Search ..... 36/115; 280/11.19, 280/11.2, 11.22, 11.23

[56] References Cited

U.S. PATENT DOCUMENTS 4,408,403 10/1983 Martin ..... 36/115
4,418,929 12/1983 Gray ..... 280/11.23
5,125,172 6/1992 Iwama et al. ..... 36/136
5,171,033 12/1992 Olson et al. ..... 36/115
5,193,827 3/1993 Olson ..... 280/11.22
5,276,983 1/1994 Hatfield ..... 36/138
5,331,752 7/1994 Johnson et al. ..... 36/115

*Primary Examiner*—Steven N. Meyers
*Attorney, Agent, or Firm*—R. Neil Sudol; Henry D. Coleman

[57] ABSTRACT

A skate with aligned wheels including a shell which is monolithic with a support for the wheels. The shell is open upwardly and to the rear, and a quarter and a tongue can be slidingly and selectively associated therewith, respectively in a rear position and in an upward region. The quarter has, in a rearward region, a grip handle for the user. The skate also includes a brake which is associable, in a snap-together manner, at a frame which can be associated with the support. A skate with aligned wheels is thus obtained in which it is possible to vary the size number merely by varying the placement of the quarter with respect to the shell; the skate can furthermore be carried easily by the user.

13 Claims, 2 Drawing Sheets

1
2
3
4a
4b
5
6
7
9
10a
10b
11
12
13a
13b
14a
14b
15a
15b
16a
16b
17a
17b
18
19
20a
23
24

SKATE WITH ALIGNED WHEELS

BACKGROUND OF THE INVENTION

The present invention relates to a skate with aligned wheels.

Conventional skates of this type are constituted by a usually U-shaped support, with its wings directed toward the ground. An item of footgear is associated above the U-shaped support.

These conventional skates have some drawbacks: first of all there is the problem of handling, both at the production level and at the storage level, because the items of footgear have different dimensions according to the sizes to be covered.

On one hand, this leads to the production of a limited number of sizes, which usually forces the user to purchase a size which is not suited to the specific dimensions of his foot. The user has to resort to contrivances, such as the use of a thick sock, to increase comfort while trying to occupy the excess space so as to transmit the efforts of the foot to the skate in an optimum manner.

Another problem resides in the fact that since conventional skates are made of multiple components which must be assembled together, they require several manufacturing steps, thus increasing the overall costs of the skate.

Furthermore, although some components are made of light weight plastic material, because of the number of wheels usually associated with the support, the skate has a considerable weight, and this creates trouble for the user during transport, which is usually done by storing the skates in adapted bags.

Of course, these bags cannot be always carried by the user during sports practice, so that once the skates are no longer being worn they must be held one in each hand, thus limiting other activities of the user.

Finally, mention is made of the technical problem that a brake is associated with said skates in a rearward position at the support; since said brake is subjected to considerable wear, its soft rubber part must be replaced often: this operation is not always easy, because usually this part is glued at an adapted frame which is rigidly coupled to the support.

SUMMARY OF THE INVENTION

The aim of the present invention is to solve the described technical problems, eliminating the drawbacks observed in the known art, by providing a skate with aligned wheels in which it is possible to vary, within a set range, its dimensions and thus its size to adapt it to the specific anatomical requirements of the individual user.

Within the scope of the above aim, an important object is to provide a skate with aligned wheels which has very low manufacturing and storage costs.

Another important object is to provide a skate with aligned wheels in which it is also possible to limit costs due to the manufacture of the molds for obtaining the individual components.

Another important object is to provide a skate with can be easily carried by the user when not in use.

Another important object is to provide a skate which allows a rapid and easy replacement of the brake if it is worn.

Another object is to provide a skate which is reliable and safe in use and has low overall manufacturing costs.

This aim, these objects and others which will become apparent hereinafter are achieved by a skate with aligned wheels, comprising a monolithic shell having a support for said wheels and being open upwardly and to the rear, a quarter and a tongue being slidingly and selectively associable with said shell respectively in a rear position and in an upward region, said quarter having, in a rearward region, at least one grip means for the user, said skate comprising a brake which is associable, in a snap-together manner, with a frame, said frame being associated with said support.

BRIEF DESCRIPTION OF THE DRAWINGS

Further characteristics and advantages of the present invention will become apparent from the detailed description of a particular but not exclusive embodiment thereof, illustrated only by way of non-limitative example in the accompanying drawings, wherein.

DESCRIPTION OF THE PREFERRED EMBODIMENTS

Figures 1, 2, 3:
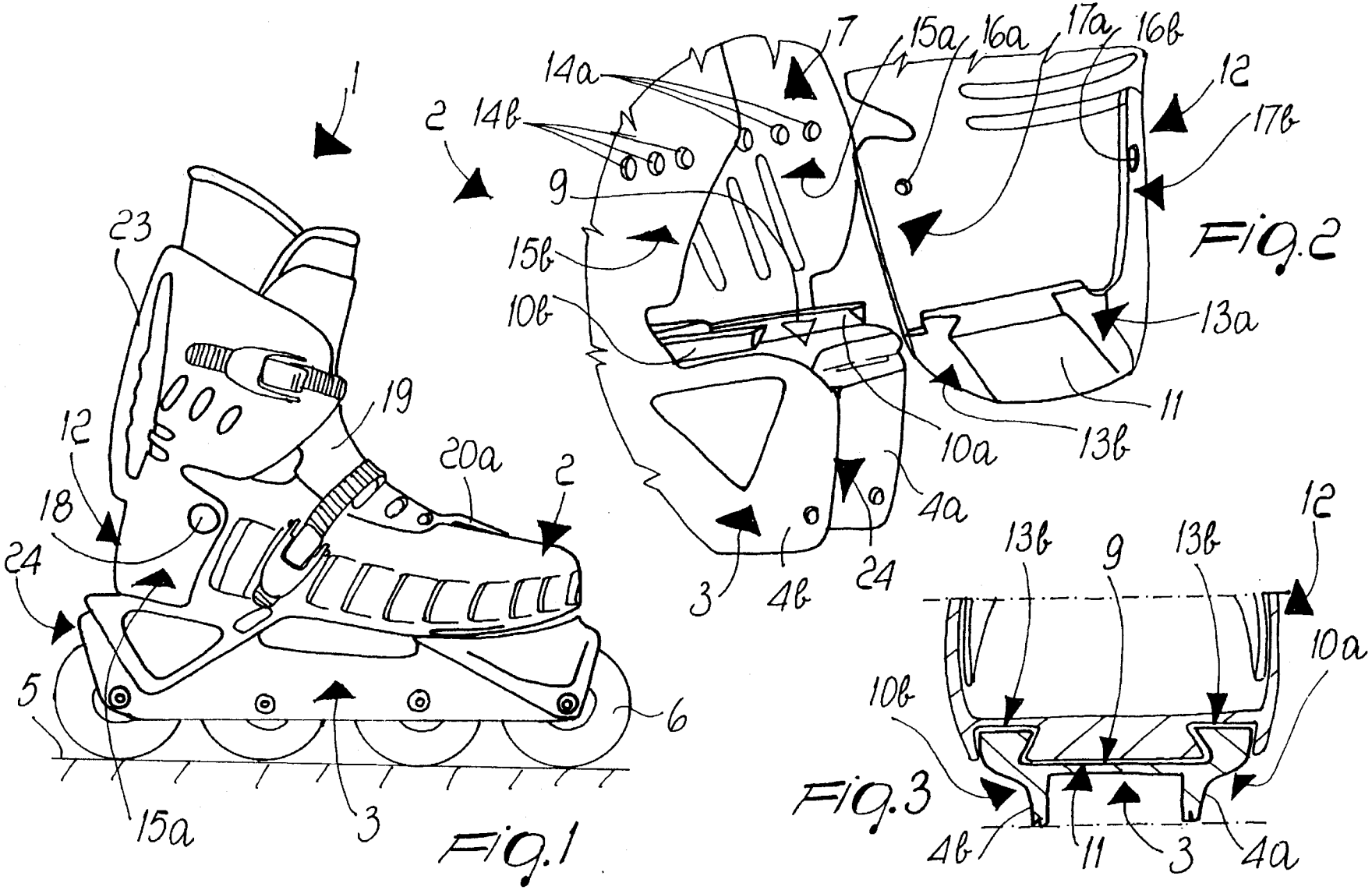
FIG. 1 is a side view of the skate according to the present invention.
FIG. 2 is a partially sectional perspective view of guiding means provided on said shell for engagement means formed on the rear quarter.
FIG. 3 is a partial cross-section view of the skate, taken along a median transverse plane at the region where the shell and the quarter connect.
Figure 4:
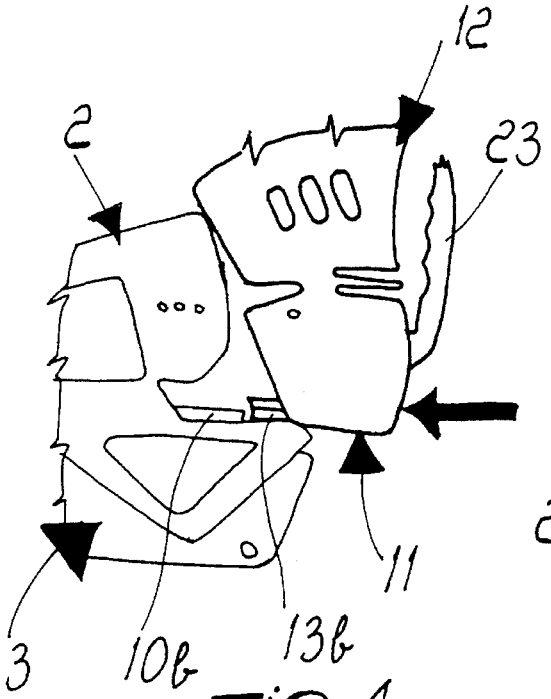
FIG. 4 is a side view of the coupling between the quarter and the shell.
Figure 5:
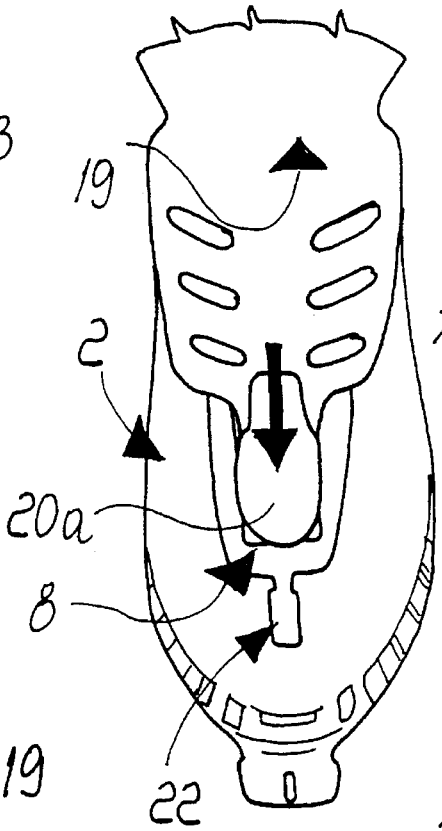
FIG. 5 is a top view of the tongue which can be associated with the shell.
Figure 6:
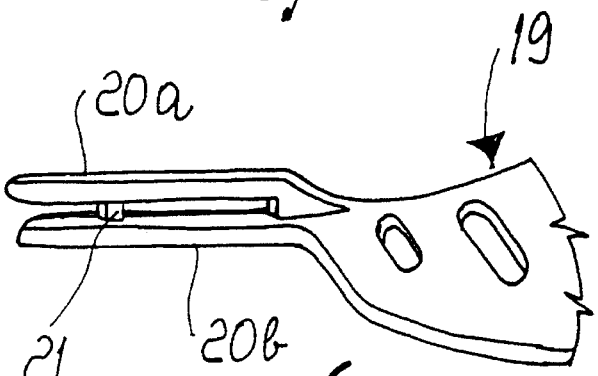
FIG. 6 is a side detail view of the tip of the tongue.
Figure 8:
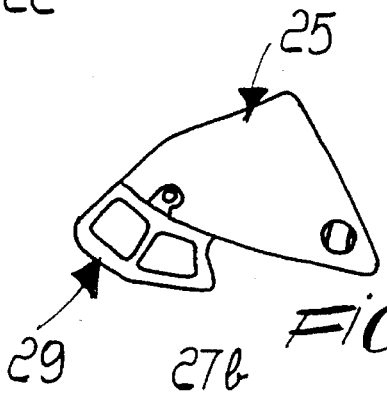
FIG. 8 is a side detail view of the brake associated with the frame.
Figure 7:
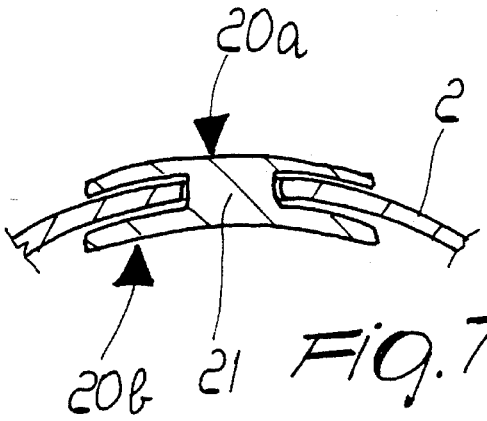
FIG. 7 is a sectional view of the tongue associated with the shell, taken along a transverse median plane.
Figure 9:
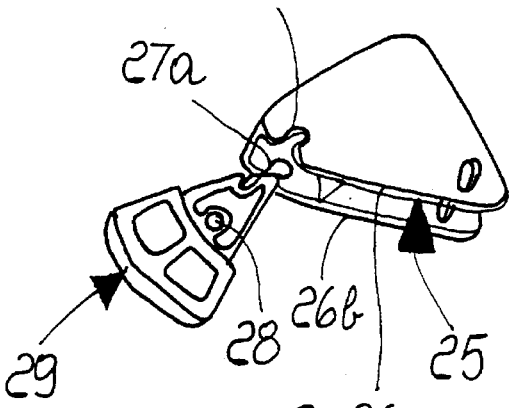
FIG. 9 is a perspective view of the brake disengaged from the frame.

With reference to the above figures, the reference numeral 1 generally designates the skate, which comprises a shell 2 formed monolithically with an underlying support 3 which is essentially U-shaped with its wings **4*a* and 4*b* directed toward the ground 5; mutually aligned wheels 6** are associated with said wings.

The shell 2 has a first opening 7 to the rear, at the region of the heel of the foot, and a second opening 8 in an upward position at the foot instep region.

A guide means is provided at the first opening 7, on the surface 9 of the shell 2 arranged below the heel of the user. The guide means comprises a pair of longitudinal raised portions **10*a* and 10*b*, which protrude from said surface 9** and are arranged approximately parallel to one another.

Said guide means interacts with a complementarily shaped engagement means formed at the lower surface 11 of a quarter 12 which is slidingly and selectively associable with the shell 2.

The engagement means comprises a pair of first seats **13*a* and 13*b* formed longitudinally at the lower surface 11 of the quarter 12**. The lower surface approximately affects the region underlying the heel of the user's foot.

Selective connection between the quarter 12 and the shell 2 occurs by virtue of the presence of a plurality of adapted first holes 14*a* and 14*b* formed at the lateral surface 15*a* and 15*b* of the shell 2.

Adapted second holes 16*a* and 16*b* can be made to interact with the first holes. The second holes are formed laterally with respect to the lateral surfaces 17*a* and 17*b* of the quarter 2, so that said first and second holes have the same axis, according to the longitudinal movement imparted to the quarter 12 toward the shell 2, so as to allow mutual coupling by means of adapted studs 18.

A tongue 19 can be arranged at the second opening 8; said tongue wraps around the instep region of the user's foot and is also provided with a pair of longitudinal tabs 20*a* and 20*b* which are arranged approximately on mutually parallel planes and are kept uniformly spaced by an adapted intermediate spacer 21.

The spacer can be arranged, in a snap-together manner, at an adapted second seat 22 formed along the longitudinal median axis of the shell 2 and connected to the second opening 8.

A grip means, constituted by a handle 23 appropriately shaped for optimum grip for the user, is also provided at the rear region of the quarter 12.

A frame 25 is detachably associable at the rear end 24 of the support 3 and has, at the lateral perimetric edges 26*a* and 26*b*, a pair of third seats 27*a* and 27*b* for temporary snap-action engagement with adapted cylindrical pins 28 which protrude laterally with respect to a brake 29 having a surface directed toward the ground 5.

Use of the skate according to the present invention is thus as follows: first of all, at the production level it is possible to provide a single mold to obtain, in a single step, both the shell and the wheel support, whereas the quarter and the tongue can be obtained separately.

By virtue of the possibility of selectively mutually coupling the quarter 12 and the shell 2, it is possible to produce a limited number of components having the preset dimensions, nonetheless allowing the user to exactly define his own size by matching the second holes 16*a* and 16*b* with one of the various first holes 14*a* and 14*b* formed on the lateral surfaces of the shell 2.

Furthermore, the detachability of the tongue with respect to the shell equally allows one to provide, in the extreme, first a single tongue which can be used in shells of different sizes.

Furthermore, by means of the handle 23 the skate can be easily carried by the user when said skate is not in use.

Furthermore, the possibility of temporarily associating the brake 29 with the frame 25, which is in turn associable with the support 3, allows the user to perform easy replacement without requiring particular tools.

It has thus been observed that the invention has achieved the intended aim and objects, a skate having been obtained in which it is possible to adapt its dimensions according to the specific anatomical shape of the user's foot, continuously varying the size merely by moving the quarter 12 with respect to the shell 2. Furthermore, the execution of said shell together with the support promotes cost containment for the manufacture of the molds as well as the number of components to be stored.

Furthermore, the presence of the handle 23 facilitates skate carrying by the user, since the user can hold a pair of skates with a single hand.

Furthermore, the presence of the tongue 19 which is selectively associable with the shell 2 allows one to further reduce the number of components of the skate.

Finally, the possibility of easily replacing the brake should be considered as a way for simplifying user maintenance of said brake.

The materials and the dimensions which constitute the individual components of the skate, such as for example the number of the first or second holes, may naturally be the most pertinent according to the specific requirements.

I claim:

1. An in-line skate comprising:

a shell having an upper portion provided with a first opening and a rear area provided with a second opening;

a plurality of wheels;

a support for holding said wheels in a mutually aligned array, said shell being integral along a lower side with said support;

a quarter;

guide means provided on said shell at said rear area for slidably connecting said quarter and said shell, thereby providing the skate with a variable size for accommodating users of different anatomical requirements; and a separate tongue member connected to said upper portion of said shell at said first opening.

2. The skate according to claim 1 wherein said guide means includes a pair of longitudinally extending raised portions protruding from a surface of said shell, said quarter being formed with seats for slidingly receiving said raised portions.

3. The skate according to claim 1, further comprising grip means integral with said quarter for facilitating a carrying of the skate.

4. The skate according to claim 3 wherein said grip means is a handle formed monolithically with said quarter.

5. The skate according to claim 1, further comprising means on said shell and said quarter for selectively fixing a position of said quarter with respect to said shell.

6. The skate according to claim 5 wherein said means for selectively fixing includes a plurality of first holes formed at lateral surfaces of said quarter, a plurality of second holes formed at lateral surfaces of said shell, and studs engaging said quarter and said shell through selectable ones of said first holes and said second holes.

7. The skate according to claim 1 wherein said tongue includes a pair of longitudinally extending parallel tabs uniformly distanced from one another by a spacer element, a seat being provided along said upper portion of said shell for receiving said spacer in a snap-lock fit, said seat being formed along a longitudinal median axis of said shell at said first opening.

8. An in-line skate comprising:

a shell having an upper portion provided with a first opening and a rear area provided with a second opening;

a plurality of wheels;

a support for holding said wheels in a mutually aligned array, said shell being integral along a lower side with said support;

a quarter;

coupling means provided on said shell and said quarter for enabling connection of said quarter to said shell at different positions over said second opening so that the skate is provided with a variable longitudinal dimension for accommodating users of different anatomical requirements; and a tongue member connected to said upper portion of said shell at said first opening.

9. The skate according to claim 8 wherein said coupling means includes a pair of longitudinally extending raised portions protruding from a surface of said shell, said quarter being formed with seats for slidingly receiving said raised portions.

10. The skate according to claim 8, further comprising grip means integral with said quarter for facilitating a carrying of the skate.

11. The skate according to claim 10 wherein said grip means is a handle formed monolithically with said quarter.

12. The skate according to claim 8 wherein said coupling means includes a plurality of first holes formed at lateral surfaces of said quarter, a plurality of second holes formed at lateral surfaces of said shell, and studs engaging said quarter and said shell through selectable ones of said first holes and said second holes.

13. The skate according to claim 8 wherein said tongue includes a pair of longitudinally extending parallel tabs uniformly distanced from one another by a spacer element, a seat being provided along said upper portion of said shell for receiving said spacer in a snap-lock fit, said seat being formed along a longitudinal median axis of said shell at said first opening.

* * * * *